United States Patent [19]

Zorzetto

[11] Patent Number: 4,608,722

[45] Date of Patent: Sep. 2, 1986

[54] ARMCHAIR OR SOFA STRUCTURE TRANSFORMABLE INTO A BED

[75] Inventor: Renato Zorzetto, Vedano Al Lambro, Italy

[73] Assignee: STEMA S.a.s. di Zorzetto Renato and Co., Ronco Briantino, Italy

[21] Appl. No.: 549,705

[22] Filed: Nov. 7, 1983

[51] Int. Cl.[4] ..... A47C 17/20; A47C 13/00

[52] U.S. Cl. ..... 5/18 R; 5/13; 5/37 R; 297/112

[58] Field of Search ..... 5/12 R, 13, 37 R, 37 B, 5/37 C, 18 R, 18 B, 38, 39, 41, 42, 56, 44 R, 44 B; 297/112, 114, 105

[56] References Cited

U.S. PATENT DOCUMENTS

| | | | |
|---|---|---|---|
| 3,385,631 | 5/1968 | Gertler | 5/18 R |
| 4,007,961 | 2/1977 | Costa | 5/18 R |
| 4,016,611 | 4/1977 | Harty | 5/13 |
| 4,204,287 | 5/1980 | Lane et al. | 5/18 R |
| 4,495,887 | 1/1985 | Mondrush | 5/37 R |

FOREIGN PATENT DOCUMENTS

| | | | |
|---|---|---|---|
| 2659526 | 7/1977 | Fed. Rep. of Germany | 297/105 |

OTHER PUBLICATIONS

Hodry-Metallwarenwerk R. Hoppe GmbH & Co. KG, Telescopic Snap Positioner.

*Primary Examiner*—Gary L. Smith
*Assistant Examiner*—Vinh Luong
*Attorney, Agent, or Firm*—Panitch Schwarze Jacobs and Nadel

[57] ABSTRACT

Armchair or sofa structure transformable into a bed in which, during the passage from one state to the other, intermediate positions can be obtained. The structure can therefore be utilized not only as a bed and as a sofa with its back portion vertical, but also in other positions with the back portion variously inclined.

3 Claims, 10 Drawing Figures

ARMCHAIR OR SOFA STRUCTURE TRANSFORMABLE INTO A BED

BACKGROUND OF THE INVENTION

This invention relates to an armchair or sofa structure transformable into a bed.

More particularly, the invention relates to a structure of the aforementioned type in which the seat structure is slidable longitudinally on a support base, and simultaneously with said sliding there open-apart two parts which form the back portion, namely a front part and rear part respectively, which on termination of their mutual withdrawal movement become disposed in the plane of the bed, as they are hinged together at their top.

Structures of this type are generally known, and they have enabled the problem of forming a structure transformable from a sofa or armchair into a bed and viceversa in an economically advantageous manner, without using the complicated and costly mechanisms of conventional sofa-bed frames.

However, such structures have drawbacks which make their use by the user difficult, and make the operations involved in transforming from one state of use to the other uncomfortable.

In this respect, it is known that said structures can be used only in two utilization positions, i.e. with the back portion completely vertical for use as a sofa or armchair, and with the back portion completely open for use as a bed respectively. It is not possible to set the structures in question in intermediate positions which can be likewise utilized by the user.

A further drawback of conventional structures is the fact that passage from the bed state to the sofa state is extremely laborious, particularly with regard to the initial operation involved in the upward folding movement, and the consequent mutual approach of the parts constituting the back portion.

A further drawback of currently known structures is that in order to maintain the structure securely in the sofa or armchair position, i.e. to prevent undesirable opening thereof, complex temporary locking members must be provided on the slidable part of the seat portion and on the fixed base, so that when in the closed position, said means prevent relative movements of these two parts.

SUMMARY OF THE INVENTION

An armchair or sofa structure transformable into a bed and viceversa which obviates all the aforesaid drawbacks has now been created, and constitutes the subject matter of the present invention.

The object of the present invention is therefore to provide a structure of the type in question in which all the operations necessary for transforming it from one state of the other are facilitated.

A further object of the invention is to provide a transformable structure in which, during passage from one state to the other, all intermediate positions can be easily obtained by virtue of the suitable means with which the structure is provided. This latter can therefore be utilized not only as a bed and as a sofa with its back portion vertical, but also in other positions with the back portion variously inclined.

Finally, the transformation operations are facilitated, by marking the force required of the user minimum, if not nullified.

BRIEF DESCRIPTION OF THE DRAWINGS

The characteristics and advantages of the armchair or sofa structure transformable into a bed and viceversa according to the present invention will be apparent from the detailed description given hereinafter of a non-limiting embodiment thereof, with reference to the accompanying figures in which.

DETAILED DESCRIPTION OF THE PREFERRED EMBODIMENT

Figure 3:
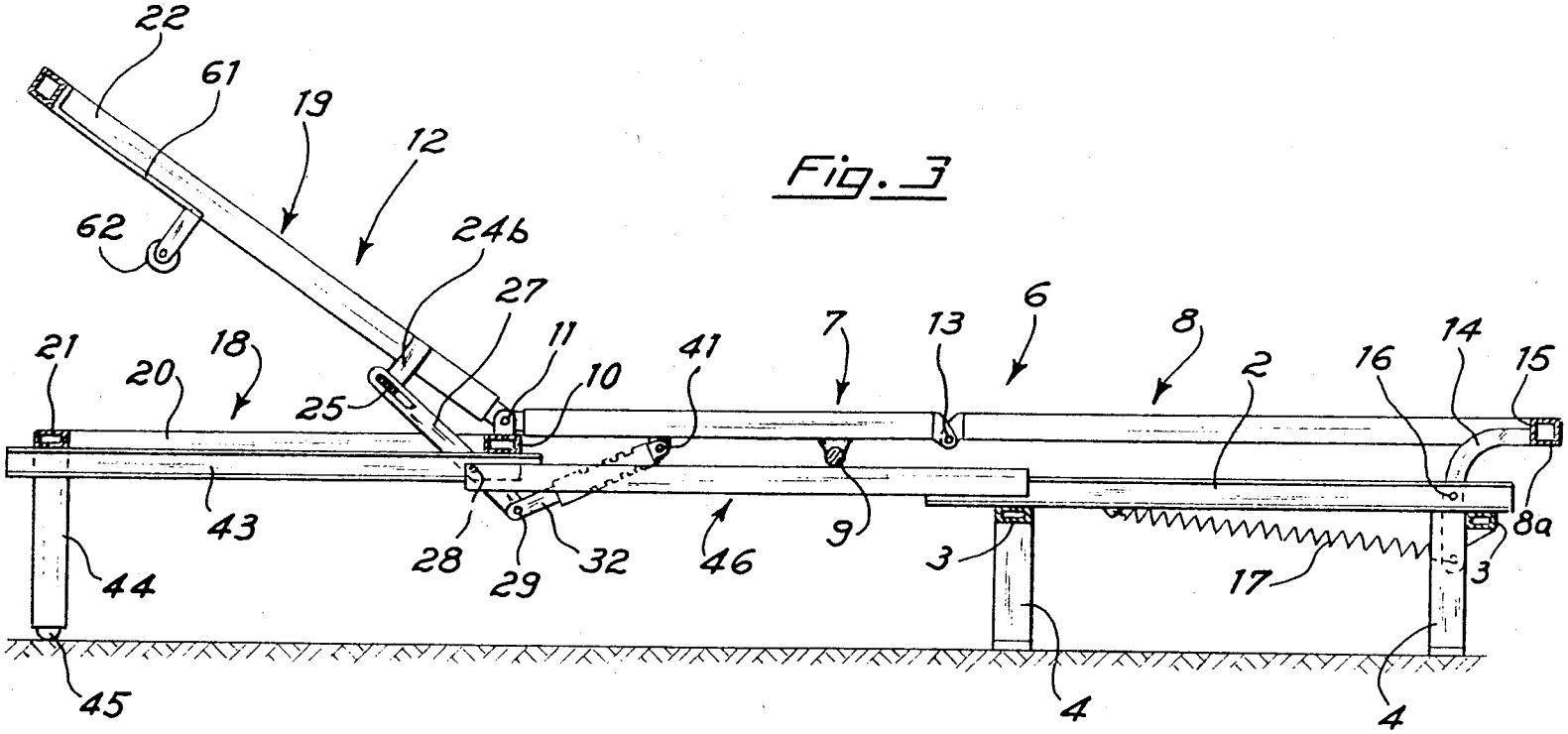
FIG. 3 is a view representing the structure in its initial position of folding from a bed to an armchair.
Figure 4:
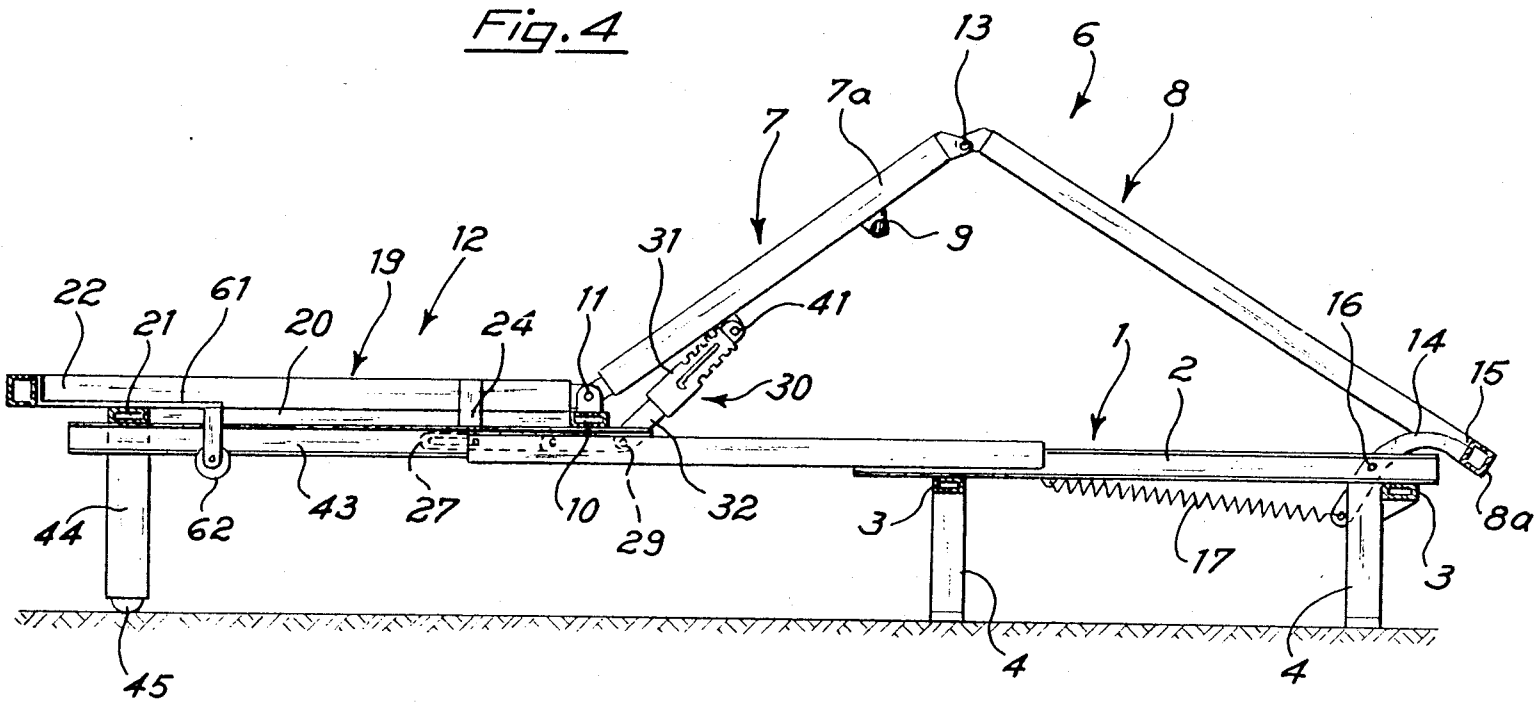
FIG. 4 is a view showing a stable intermediate position between the bed position and armchair position obtainable by the structure according to the present invention.
Figure 5:
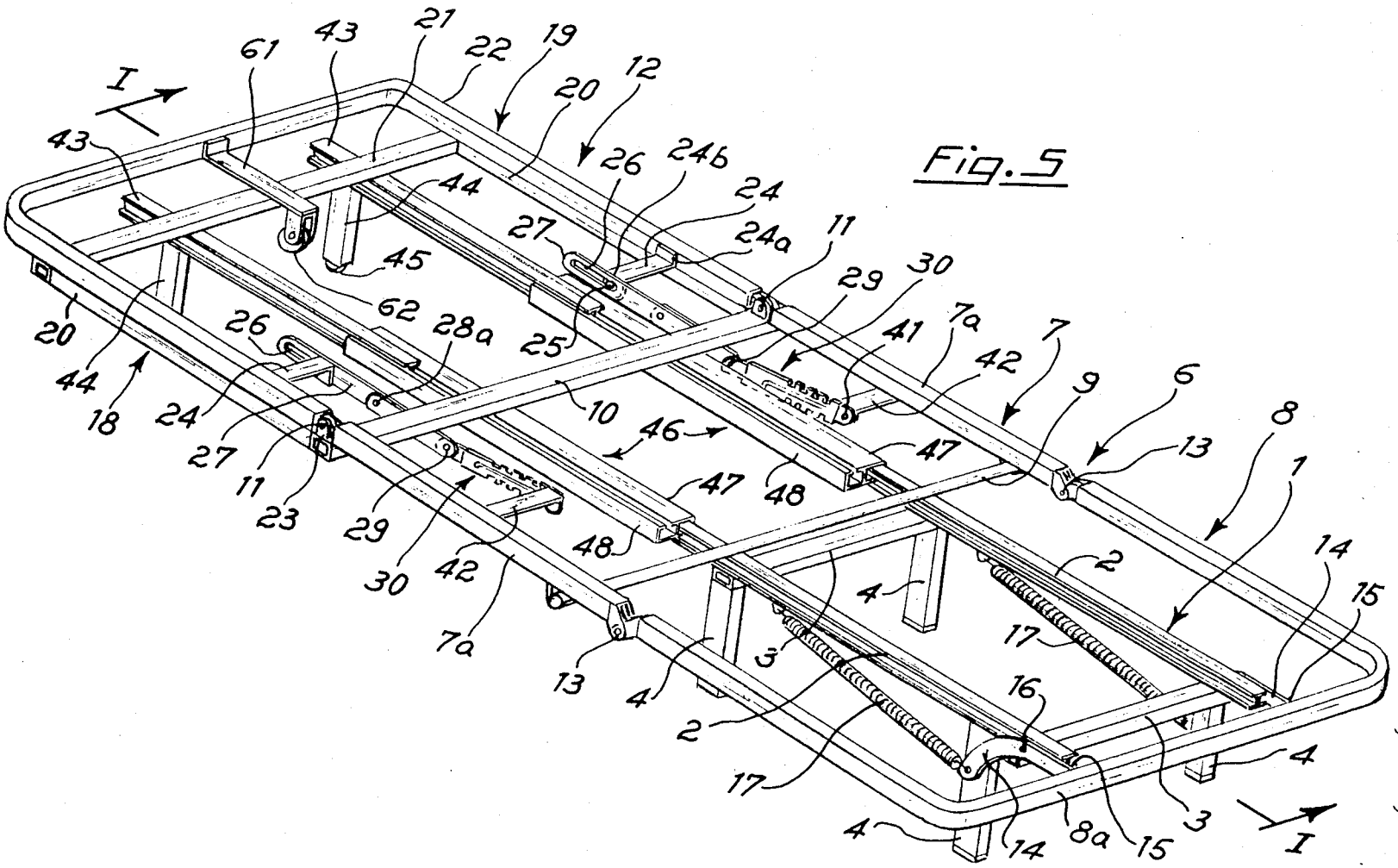
FIG. 5 is a perspective view of the structure according to the invention in the bed position.

Before describing the embodiment of the structure according to the present invention in detail, it should be noted that FIGS. 1 to 4 are all longitudinal central sectional views on the line I—I of FIG. 5. This is done for reasons of clarity of illustration, these views representing one half of the structure, the other half, not shown, being identical.

With reference to FIGS. 1 to 5, the structure according to the invention comprises a fixed base indicated overall by 1, consisting essentially of two parallel lateral longitudinal members 2 connected together lowerly by two cross-members 3 fixed thereto in any known manner, and supported by four support legs 4. Specifically, the front legs 4 are fixed to the relative cross-member 3, whereas the rear legs 4 are fixed directly to the longitudinal members 2.

Figure 1:
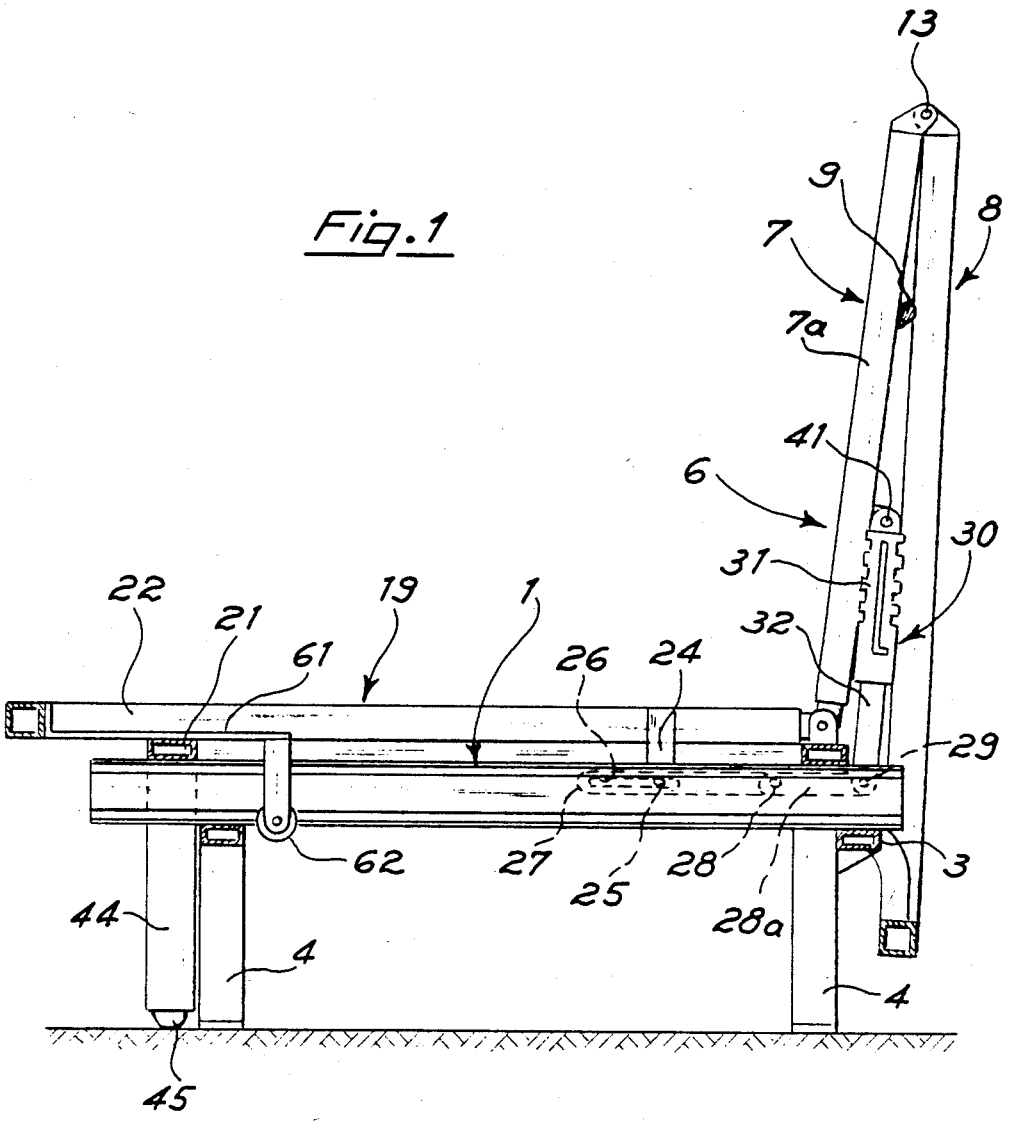
FIG. 1 is a view of the structure in its position of use as an armchair or sofa.
Figure 2:
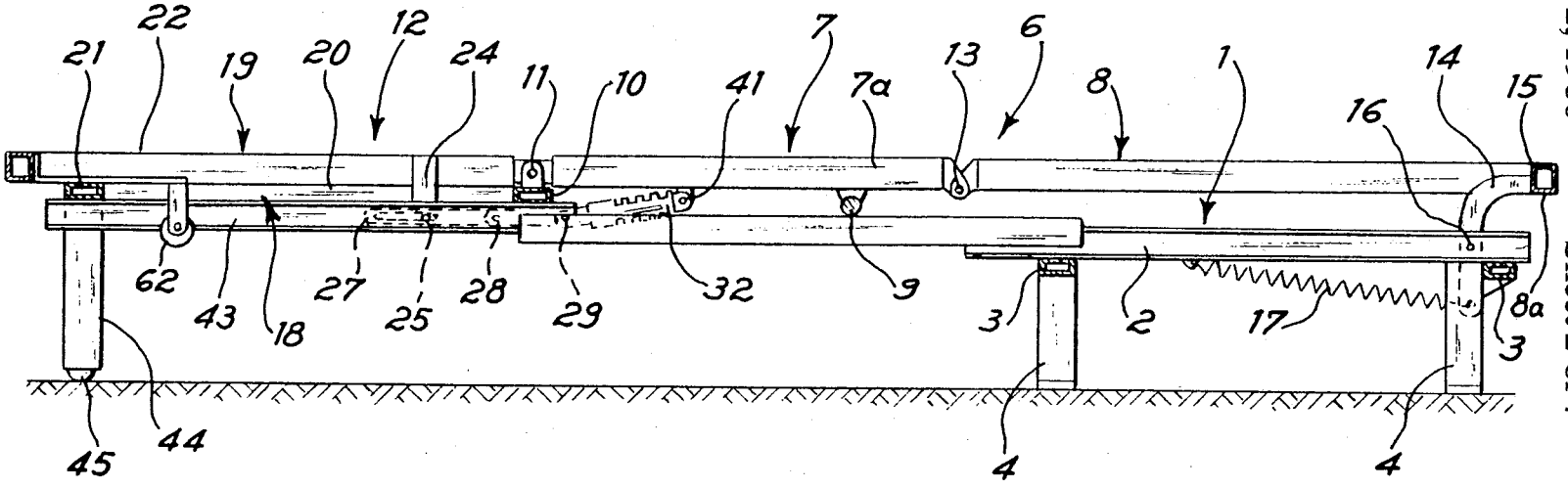
FIG. 2 is a view thereof in its position of use as a bed.

The structure also comprises a back portion, indicated overall by 6, which is formed in two parts, namely a front part 7 and a rear part 8 respectively, and arranged to lie side-by-side as shown in FIG. 1 when in the sofa position, or aligned as shown in FIG. 2 when in the bed position.

With particular reference to FIG. 5, the front part 7 of the back portion is constituted by two lateral longitudinal members 7*a*, of which the distance apart is greater than that of the longitudinal members 2 of the base 1, and which are connected together, on the same side as the rear part 8 of the back portion, by a cross-member 9 fixed to them in any known manner. At the other end, the longitudinal members 7*a* are pivoted to the ends of a cross-member 10 by means of a pair of hinges 11, said cross-member 10 constituting one of the sides of a quadrilateral forming part of the seat structure of the sofa, indicated overall by 12 and described hereinafter.

The front part 7 and rear part 8 of the back portion are hinged together by a pair of hinges 13, and as can be seen in particular from FIG. 5 the rear part 8 of the back portion is substantially of U configuration, and its width is greater than the distance between the longitudinal members 2 of the base 1.

As can be seen in particular from FIGS. 2 to 5, the rear part 8 of the back portion is supported by the longitudinal members 2 of the base 1 by way of a pair of levers 14, one for each longitudinal member, and which are substantially of L configuration. One of their ends is fixed in any known manner at 15 to the rear side 8*a* of the part 8 of the back portion, said levers 14 being pivoted by means of a pin 16 to the longitudinal members 2. The other end of the levers 14 is connected by a spring 17 to the longitudinal members 2 in a region distant from the side 8*a* of the rear part 8 of the back portion. The purpose of the spring 17 is to facilitate the operation involved in opening and closing the structure.

The seat portion 13 of the structure to the present invention comprises a lower frame 18 and an upper frame 19, which are connected together at that end which is in a position corresponding with the front part 7 of the back portion 6.

In particular, the lower frame 18 is constituted by a substantially rectangular structure, one side of which consists of the aforesaid cross-member 10, and the remaining three sides consist of two longitudinal members 20 spaced-apart by a distance substantially equal to that between the longitudinal members 7*a*, and a cross-member 21 which connectes together the ends of said longitudinal members 20. These elements can be fixed in any known manner.

The upper frame 19 of the seat portion 12 is constituted by a section 22 of substantially U profile, of which the ends are hinged to the same hinge 11 to which the longitudinal members 7*a* are hinged. For this purpose, the cross-member 10 comprises at its ends flanges 23 which allow said hinges to be fitted.

As can be seen in particular from FIG. 3, the upper frame 19 of the seat portion 12 can thus rotate relative to the lower frame 18 by virtue of the aforesaid hinges 11, and said movement, by means of the mechanism described hereinafter, is able both to facilitate the operation of transforming the structure from a bed to a sofa, and to obtain intermediate utilisation position for the structure, i.e. stable positions with the back portion variously inclined.

With particular reference to FIG. 5, the aforesaid mechanism comprises, for each side of the structure, a substantially S-shaped arm 24, one end 24*a* of which is fixed in any manner to the inner face of the section 22 of the upper frame 19, whereas the other end 24*b* comprises a pin 25 slidable in a slot 26 of a rod 27 pivoted at 28 to a plate 28*a* fixed lowerly to the cross-member 10. To the other end there is hinged at 29 a telescopic positioner of known type which can be adjusted by snap movements, it being indicated overall by 30 and described briefly hereinafter with particular reference to FIGS. 9 and 10. This positioner is in fact of the type produced by the firm Hodry-Metallwarenwerk R. Hoppe GmbH & CO. KG.

The positioner 30 comprises substantially a sleeve or outer sheath 31 in which a substantially flat rod 32 slides. The sleeve or outer sheath 31 comprises in its lateral edges apertures 33, at which the outer profile of the sleeve 31 is in the form of recesses 34. Inside the sleeve 31, and engaged with the profiled end of the rod 32, there are provided two elements 35 of which one end 36 is engaged with the end of the rod 32, whereas the other end 37 is shaped substantially in the form of a tooth with a flat face 37*a* on one side and an inclined face 37*b* on the other side. Between the two elements 35 there is disposed a spring 38, the purpose of which is to keep the toothed end 37 of the elements 35 in the position shown in FIG. 10, i.e. projecting outwards from the apertures 33.

The operation of the aforesaid positioner is described briefly hereinafter merely for the sake of completeness.

Figure 9:
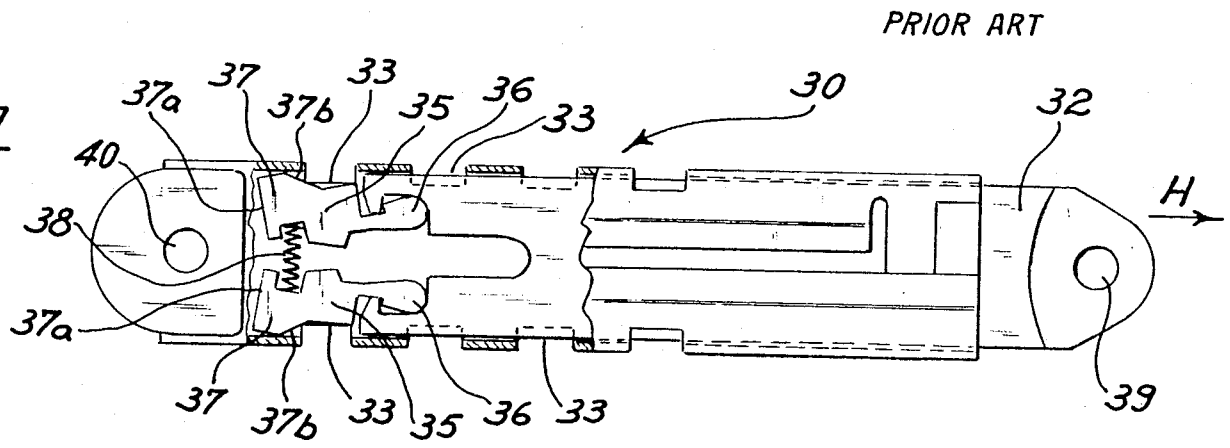
FIGS. 9 and 10 are views to an enlarged scale showing the means which enable the aforesaid intermediate position to be obtained.
Figure 10:
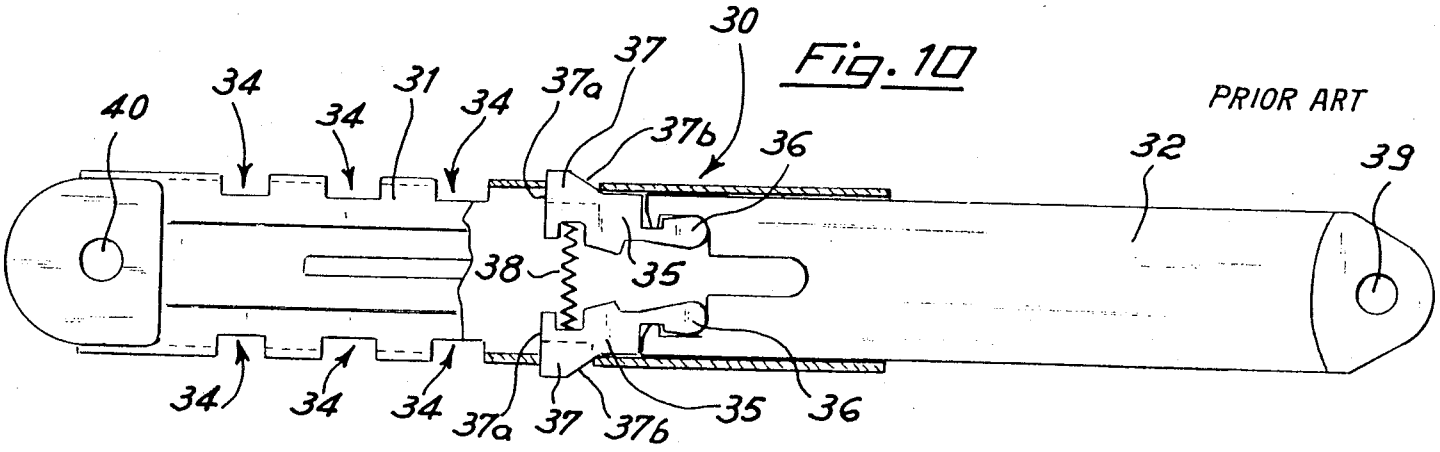

It will be assumed that the starting position is that shown in FIG. 9, in which the rod 32 is completely inserted into the sleeve 31. In this position, the toothed parts 37 of the elements 35 are within the sleeve 31. If it is now assumed that a traction force is exerted on the rod 32 towards the right in FIG. 9 in the direction of the arrow H, it is apparent that due to the action of the spring 38 the elements 35 become positioned with the toothed part projecting outwards from the apertures 33 as shown in FIG. 10, which illustrates the last position which can be attained by the rod 32. It is apparent that the traction force on the rod 32 can be interrupted at any of the apertures 33, to obtain in this specific case four positions of the rod 32 in which it is unable to withdraw into the sleeve 31 because this movement is prevented by the toothed parts 37 of the elements 35. Movement in the direction of the arrow H is however possible because of the fact that the aforesaid parts 27 are able to retract by compressing the spring 38.

Continuous withdrawal of the rod 32 into the sleeve 31 is however possible in that, on continuing the movement in the direction of the arrow H, a stop element 31*a* of the sleeve 31 acts on a projection 31*e* of a wedge element 31*b* slidable in a slot 31*g*, to cause it to become inserted between the ends 36 of the elements 35, so locking them in the position shown in FIG. 9 and enabling the rod 32 to withdraw into the sleeve 31.

The elements 35 are then released when the wedge element 31*b* engages with another stop element 31*c* of the sleeve 31, so that a profiled part 31*f* thereof returns into a seat 31*d* of the rod 32, the wedge element 31*b* then being retained in this latter.

At its respective ends, the positioner 30 comprises a bore 39 in the rod 32 and a bore 40 in the sleeve 31, which enables it to be fitted to a structure as in the case of the structure according to the present invention. In particular, the bore 39 enables the positioner to be fitted on to the aforesaid pin 29, while the bore 40 enables the positioner 30 to be pivoted to a pin 41 of a rod 42 fixed lowerly at its other end to the longitudinal member 7*a* of the front part 7 of the back portion.

Finally, the structure according to the invention comprises means for connecting the seat portion 12 to the base 1, to allow relative movement of these two parts.

Figure 6:
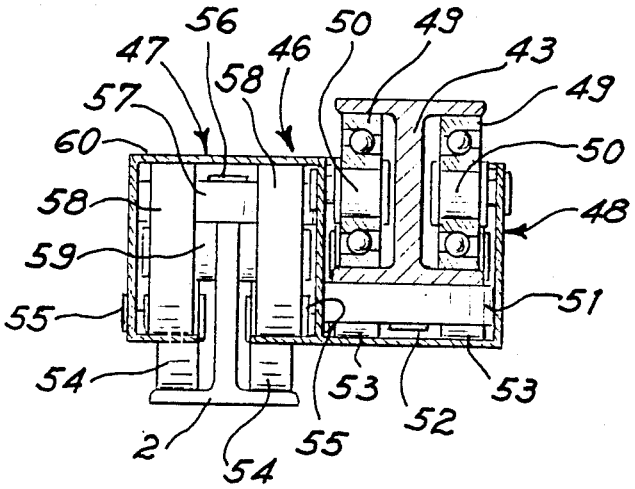
FIG. 6 is a cross-section on the line VI—VI of FIG. 7 showing the guides for the sliding of the seat on the base, with which the structure according to the present invention is provided.
Figure 7:
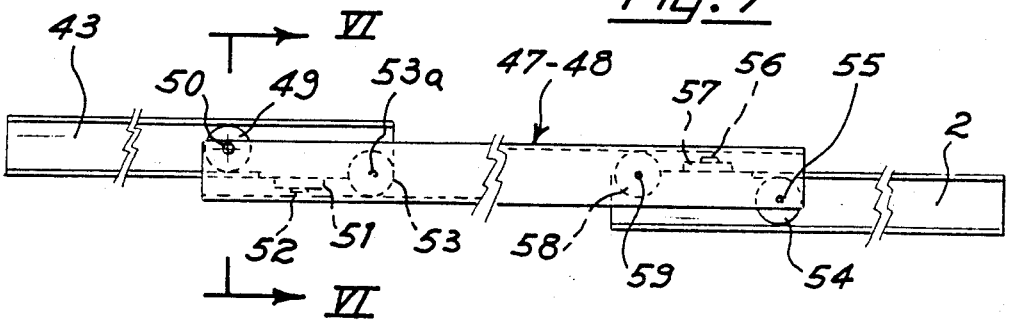
FIG. 7 is a side view of said slide guides.
Figure 8:
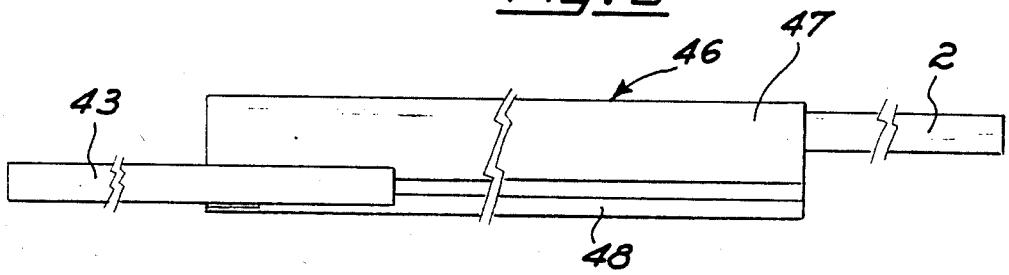
FIG. 8 is a plan view showing said slide guides.

With reference to FIG. 5 and in particular to FIGS. 6 to 8 in which said means are shown in greater detail, these connection means comprise, at the end corresponding to the back portion 12, a pair of double T sections 43, of which the longitudinal axis is slightly offset from but parallel to the longitudinal axis of the longitudinal members 2 of the base 1.

In proximity to one of their ends, the sections 43 are fixed to the lower side of the cross-member 21 of the fixed frame 18, to said cross-member 21 there being also lowerly fixed two legs 44 provided at their bottom with slide rollers 45.

The sliding connection between the sections 43 and longitudinal members 2 is obtained by providing, between each pair of these elements, a substantially box-like member 46 constituted substantially by two tubular side-by-side elements 47, 48, in which the section 2 and 43 slide by virtue of the means described hereinafter.

With particular reference to FIGS. 6 to 8, one of the two tubular members, namely the tubular member 48, comprises at one end a pair of ball bearings 48, each of which is rotatable on a pin 50 fixed to the side walls of the tubular member 48. The ball bearings 48 engage with the inner face of the two horizontal sides of the double T section 43, to thus provide a support and slide element for said section.

There is also provided another ball bearing 51, disposed on a pin 52 fixed on the web of the section 43. The bearing 51 is rotatable in a plane perpendicular to that in which the bearings 49 rotate, and its side walls engage with the tubular member 48.

Two bearings 53 are provided on that end of the section 43 which can be considered ideally opposite to the corresponding end of the longitudinal member 2. The bearings 53 are disposed on a pin 53*a* of the web of the section 43, and are rotatable in a plane substantially parallel to that of the bearings 49. As can be seen in particular from FIGS. 6 and 7, they slide on the base wall of the tubular member 48, with which they remain permanently in contact.

By means of the aforesaid arrangement, an extremely stable connection is obtained between the section 43 and the tubular member 48, which prevents any misalignment between these two elements in any direction.

A similar arrangement is provided between the longitudinal member 2, also of double T profile, and the relative tubular member 47.

This arrangement can be considered symmetrical with the preceding.

Again with particular reference to FIGS. 6 and 7, two ball bearings 54 are disposed on the end of the tubular member 47, and are rotatable on pins 55 provided on the side walls of the tubular member 47. This latter slides by means of said bearings 54 on the lower horizontal side of the longitudinal member 2. Furthermore, the diameter of the bearings 54 is approximately equal to the distance between the horizontal sides of the longitudinal member 2 in order to prevent movement between the member 47 and the longitudinal member 2. On a pin 56 of this latter there is disposed a bearing 57 rotatable perpendicular to the bearings 54 and engaging with the side walls of the member 47. Two bearings 58 rotatable on a pin 59 rigid with the longitudinal member 2 are disposed on the end of the longitudinal member 2 and are rotatable in a plane parallel to the bearings 54, to slide on the upper wall 60 of the member 47.

This arrangement also obviates any possible misalignment between the longitudinal member 2 and the member 47.

Finally, the structure comprises an internally projecting bracket 61 fixed to the section 22 and having rotatably disposed on its end a roller 62 substantially at the same height as the front cross-member 3, with which it engages (FIG. 1) when in the sofa position, to act as a temporary locking device. In order to lock or release the sofa, the roller 62 passes over the cross-member 3 to cause a temporary lifting of the frame 19 of the seat portion 12, by virtue of the rigidity of the bracket 61.

The operation of the structure according to the invention is simple, and its main stages are summarised hereinafter.

It will be assumed that the starting position is that of the sofa or armchair shown in FIG. 1, from which the structure will be moved into the bed position shown in FIG. 2.

This operation is extremely simple, it being necessary only for the user to exert a pulling force on the section 22 in the direction of the front of the sofa. This causes the seat portion 12 to slide forwards, and the sections 43 and box members 46 to slide relative to each other, with the box members 46 sliding on the longitudinal member 2. The pulling force is terminated when the sofa has been moved into the position of FIG. 2 or FIG. 5. The front part 7 and rear part 8 of the back portion 6 have then rotated about the common hinge 13 to become disposed in one plane.

The telescopic snap-action positioners 30 which when in the sofa position had been set in the position shown in FIG. 9, i.e. of maximum insertion of the rod 32 into the sleeve 31, have undergone no change in their state because no force has been exerted on them.

Starting from the bed position shown in FIG. 2, the manner in which the structure is moved into its initial sofa position will now be described.

At this point it is necessary only for the user to rotate the section 22 upwards in a clockwise direction as shown in FIG. 3. This rotation leads to a likewise clockwise rotation of the lever or rocker arm 27, during which the pin 25 of the arm 24 slides in the slot 26 of the arm 27. Simultaneously, the rotation of the rocker arm 27 causes the partial emergence of the rod 32 of the positioner 30 from the sleeve 31. In this respect, this latter is connected at 41 to the front part 7 of the back portion which in this position cannot move. The extent of the emergence of the rod 32 from the sleeve 31 can be easily chosen by the user by suitably varying the angle of rotation of the section 22. At this point, with reference to FIG. 4, it is necessary only to return the section 22 into its initial position, i.e. the horizontal position, this anti-clockwise rotation leading to a consequent raising of the back portion 6 by means of the telescopic positioner 30. The extent of raising of the back portion, i.e. the inclination of its front part 7, will obviously depend on the length by which the rod 32 has emerged from the sleeve 31. In this respect, as can be seen in particular from FIG. 10, the elements 35 prevent the rod 32 from re-entering the sleeve 31 when their toothed parts 37 have emerged from the apertures 33. In FIG. 10, the elements are shown with their toothed parts 37 projecting from the end apertures 33, but it is obvious that the user can vary his action in such a manner as to cause them to project through preceding apertures 33.

Thus, in the position of FIG. 4, the structure according to the invention is in an intermediate position between the bed and sofa, and can likewise be used, which with conventional structures was not possible.

Moreover, the operational stages heretofore described considerably facilitate the return of the structure from the bed position to the sofa position by the user.

In order to return the structure from the position of FIG. 4 to the initial position of FIG. 1, it is necessary for the user only to exert a pushing action on the section 22 in the direction of the rear of the structure, by which the structure returns easily into the sofa position by virtue of the sections 43 of the box members 46 making a sliding movement in the opposite direction to the preceding, these latter members sliding on the longitudinal members 2.

It is apparent that during this movement stage, the rods 32 of the positioner 30 cannot withdraw into the relative sleeve 30, however this latter is provided in known manner, not shown, with means for releasing the elements 35, which can be returned to the position of FIG. 9 to allow the complete insertion of the rod 32 into the sleeve 31.

All the aforesaid operations are obviously facilitated by the fact that the rear part 8 of the back portion 6 is connected to the base 1 by means of the levers 14 and spring 17.

The advantages deriving from the use of the structure according to the present invention are apparent from the aforegoing description, and to which all obvious modifications can be made which fall within the scope of the inventive idea, without leaving the scope of protection of the invention itself.

What I claim is:

1. An armchair or sofa structure transformable into a bed of the type comprising, on a fixed base, a back portion including a front part and a rear part upperly hinged together, and a seat portion, the front part being connected to the seat portion, the seat portion being slidable relative to the base in the direction of a front of the structure, said sliding causing the two parts of the back portion to lie in one plane, wherein the seat portion includes a lower frame connected to the base by means which enable the lower frame to slide relative and parallel to the base, and an upper frame hinged to the lower frame and to the front part of the back portion, the upper frame of the seat portion being also connected to the front part of the back portion by a linkage comprising a rocker lever pivoted in its intermediate region to a frame of the structure, the rocker lever being connected at one end in a slidable manner to an arm fixed to the upper frame of the seat portion and at the other end to a telescopic snap-action positioner, the positioner being connected to the front part of the back portion, said positioner being extended when the upper frame is withdrawn from the lower frame, the extent of the extension being predetermined as a function of the extent of withdrawal of the upper frame from the lower frame, the positioner further including releasable means for retaining the positioner in the extended position.

2. A structure as recited in claim 1, wherein the other end of the arm is provided with a pin, the pin being slidable in a slot of the rocker lever.

3. A struture as recited in claim 1 wherein the telescopic snap-action positioner includes a rod hinged to the end of the rocker lever, opposite to said arm and slidable in a sleeve, the sleeve pivoted to an intermediate region of the front part of the back portion.

* * * * *